US011361890B2

(12) United States Patent
Kobayashi et al.

(10) Patent No.: US 11,361,890 B2
(45) Date of Patent: Jun. 14, 2022

(54) COIL ELEMENT

(71) Applicant: TAIYO YUDEN CO., LTD., Tokyo (JP)

(72) Inventors: Satoshi Kobayashi, Tokyo (JP); Satoshi Tokunaga, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 16/941,066

(22) Filed: Jul. 28, 2020

(65) Prior Publication Data

US 2020/0357548 A1 Nov. 12, 2020

Related U.S. Application Data

(63) Continuation of application No. 15/822,733, filed on Nov. 27, 2017, now Pat. No. 10,763,020.

(30) Foreign Application Priority Data

Jan. 30, 2017 (JP) ..... JP2017-014317

(51) Int. Cl.
*H01F 27/28* (2006.01)
*H01F 27/29* (2006.01)
(Continued)

(52) U.S. Cl.
CPC ..... *H01F 5/003* (2013.01); *H01F 5/06* (2013.01); *H01F 17/0013* (2013.01);
(Continued)

(58) Field of Classification Search
CPC ..... H01F 5/003; H01F 27/29; H01F 27/255; H01F 17/04; H01F 17/0013; H01F 5/06;
(Continued)

(56) References Cited

U.S. PATENT DOCUMENTS 7,859,377 B2 * 12/2010 Kawarai ..... H01F 17/0006 336/83
9,997,288 B2 * 6/2018 Yamaguchi ..... H01F 17/0006
(Continued)

FOREIGN PATENT DOCUMENTS

JP H06-333744 A 12/1994
JP 2011-504662 A 2/2011
(Continued)

OTHER PUBLICATIONS

Non-final Office Action dated Oct. 7, 2019 issued in corresponding U.S. Appl. No. 15/822,733.
(Continued)

*Primary Examiner* — Tuyen T Nguyen
(74) *Attorney, Agent, or Firm* — Pillsbury Winthrop Shaw Pittman, LLP

(57) ABSTRACT

One object is to lessen the difference between the direction of the magnetic flux and the easy direction of magnetization in a coil element and improve the effective permeability of the coil element. A coil element according to one element of the present invention includes: a coil conductor wound around a coil axis; at least one isotropic magnetic material layer provided on at least one of an upper surface and a lower surface of the coil conductor, the at least one isotropic magnetic material layer being made of an isotropic magnetic material; and at least one anisotropic magnetic material layer provided on an opposite surface of the at least one isotropic magnetic material layer to the coil conductor, the at least one anisotropic magnetic material layer being made of an anisotropic magnetic material having an easy direction of magnetization oriented perpendicular to the coil axis.

13 Claims, 4 Drawing Sheets

(51) Int. Cl.

| | |
|---|---|
| ***H01F 5/00*** | (2006.01) |
| ***H01F 5/06*** | (2006.01) |
| ***H01F 27/245*** | (2006.01) |
| ***H01F 27/255*** | (2006.01) |
| ***H01F 17/04*** | (2006.01) |
| ***H01F 17/00*** | (2006.01) |

(52) U.S. Cl.
CPC ..... *H01F 17/04* (2013.01); *H01F 27/2455* (2013.01); *H01F 27/255* (2013.01); *H01F 27/2804* (2013.01); *H01F 27/29* (2013.01); *H01F 27/292* (2013.01)

(58) Field of Classification Search
CPC . H01F 27/2455; H01F 27/2804; H01F 27/292
See application file for complete search history.

(56) References Cited

U.S. PATENT DOCUMENTS

| | | | |
|---|---|---|---|
| 10,147,540 | B2 | 12/2018 | Tonoyama |
| 2006/0214759 | A1 | 9/2006 | Kawarai |
| 2009/0002117 | A1 | 1/2009 | Kawarai |
| 2010/0308949 | A1 | 12/2010 | Lim et al. |
| 2012/0105188 | A1 | 5/2012 | Lim et al. |
| 2014/0047704 | A1 | 2/2014 | Lim et al. |
| 2016/0027572 | A1 | 1/2016 | Lim et al. |
| 2016/0099098 | A1 | 4/2016 | Yamaguchi |
| 2016/0343498 | A1* | 11/2016 | Lee ..... H01F 17/0013 |
| 2017/0004915 | A1* | 1/2017 | Park ..... H01F 27/255 |
| 2019/0221357 | A1* | 7/2019 | Sugiyama ..... H01F 27/292 |

FOREIGN PATENT DOCUMENTS

| | | | |
|---|---|---|---|
| JP | 2012-525700 A | | 10/2012 |
| JP | 2013055232 A | * | 3/2013 |
| JP | 2016-072556 | | 5/2016 |
| JP | 2017-017314 A | | 1/2017 |

OTHER PUBLICATIONS

Notice of Allowance dated May 5, 2020 issued in corresponding U.S. Appl. No. 15/822,733.

Notice of Reasons for Refusal dated Oct. 12, 2021 issued in corresponding Japanese Patent Application No. 2018-009245, with English translation (14 pgs.).

Notice of Reasons for Refusal dated Apr. 26, 2022, issued in corresponding Japanese Patent Application No. 2018-009245 with English translation (9 pgs.).

* cited by examiner

COIL ELEMENT

CROSS-REFERENCE TO RELATED APPLICATIONS

This application is a Continuation Application of U.S. Ser. No. 15/822,733, filed Nov. 27, 2017, which is based on and claims the benefit of priority from Japanese Patent Application Serial No. 2017-014317 (filed on Jan. 30, 2017), the contents of each of which are hereby incorporated by reference in their entirety.

TECHNICAL FIELD

The present invention relates to a coil element. In particular, the present invention relates to improvement of effective permeability of a coil element.

BACKGROUND

There have been proposed techniques for improving effective permeability of a coil element. For example, Japanese Patent Application Publication No. 2016-072556 (hereinafter "the '556 Publication") discloses a coil element including a core portion made of an isotropic magnetic material, a coil conductor wound around the core portion, an outer peripheral portion provided on a radially outer side of the coil conductor and made of an isotropic magnetic material, and anisotropic magnetic material layers provided on an upper surface and a lower surface of the coil conductor.

The coil element disclosed in the '556 Publication is configured such that the core portion and the outer peripheral portion are adjacent to the anisotropic magnetic material layer in a direction perpendicular to the coil axis of the coil conductor. Therefore, the magnetic flux generated from the coil conductor is incident on the core portion and the outer peripheral portion without largely changing its direction from the easy direction of magnetization to the hard direction of magnetization in the anisotropic magnetic material layer. Accordingly, in the coil element of the '556 Publication, the magnetic flux is not oriented in the hard direction of magnetization in the anisotropic magnetic material layer, resulting in a high effective permeability.

However, in the coil element disclosed in the '556 Publication, the magnetic flux deflects from the easy direction of magnetization of the anisotropic magnetic material layer in the region in which the magnetic flux runs from the core portion or the outer peripheral portion at a side of the coil conductor to above or below the coil conductor. The reason for this is as follows.

The magnetic flux generated in the coil element disclosed in the '556 Publication is oriented in a direction substantially parallel to the coil axis at a side of the coil conductor and is oriented in a direction substantially perpendicular to the coil axis above and below the coil conductor. Therefore, in the region in which the magnetic flux runs from the side of the coil conductor to above or below the coil conductor, the direction of the magnetic flux changes from the direction parallel to the coil axis to the direction perpendicular to the coil axis. In addition, in the coil element of the '556 Publication, when the magnetic flux runs from the side of the coil conductor where it is oriented in the direction parallel to the coil axis to above or below the coil conductor, the magnetic flux is incident on the anisotropic magnetic material layer provided above or below the coil conductor. The easy direction of magnetization of the anisotropic magnetic material layer is perpendicular to the coil axis, and therefore, in the region of the anisotropic magnetic material layer adjacent to the side of the coil conductor, the magnetic flux deflects from the easy direction of magnetization of the anisotropic magnetic material layer. This deflection is particularly significant in the vicinity of the coil conductor.

Thus, the effective permeability of the coil element of the '556 Publication is impaired due to the difference between the direction of the magnetic flux and the easy direction of magnetization in the region in which the magnetic flux runs from the side of the coil conductor to above or below the coil conductor.

SUMMARY

To overcome this problem, one object of the present invention is to lessen the difference between the direction of the magnetic flux and the easy direction of magnetization in the coil element and thereby to improve the effective permeability of the coil element. In particular, one object of the present invention is to lessen the difference between the direction of the magnetic flux and the easy direction of magnetization in the region in which the magnetic flux runs from the side of the coil conductor to above or below the coil conductor. Other objects of the present invention will be made apparent through description in the entire specification.

A coil element according to one element of the present invention comprises: a coil conductor wound around a coil axis; at least one isotropic magnetic material layer provided on at least one of an upper surface and a lower surface of the coil conductor, the at least one isotropic magnetic material layer being made of an isotropic magnetic material; and at least one anisotropic magnetic material layer provided on an opposite surface of the at least one isotropic magnetic material layer to the coil conductor, the at least one anisotropic magnetic material layer being made of an anisotropic magnetic material having an easy direction of magnetization oriented perpendicular to the coil axis.

According to the embodiment, the isotropic magnetic material layer is disposed in a region in which the magnetic flux generated from the coil element runs from a side of the coil conductor to above or below the coil conductor, and therefore, the direction of the magnetic flux changes from the direction parallel to the coil axis toward the direction perpendicular to the coil axis. Thus, the magnetic flux changes its direction from the direction parallel to the coil axis toward the direction perpendicular to the coil axis in the isotropic magnetic material layer, before the magnetic flux runs into the anisotropic magnetic material layer. This makes it possible to lessen the difference between the direction of the magnetic flux and the easy direction of magnetization as compared to the case where the magnetic flux runs from the side of the coil conductor directly into the anisotropic magnetic material layer. Accordingly, the coil element of this embodiment achieves an improved effective permeability as compared to conventional coil elements in which the magnetic flux runs from the side of the coil conductor directly into the anisotropic magnetic material layer.

ADVANTAGES

According to the present disclosure, the difference between the direction of the magnetic flux and the easy direction of magnetization in the coil element is lessened to improve the effective permeability of the coil element.

DESCRIPTION OF THE PREFERRED EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear in accurate scales, for convenience of description.

Figure 1:
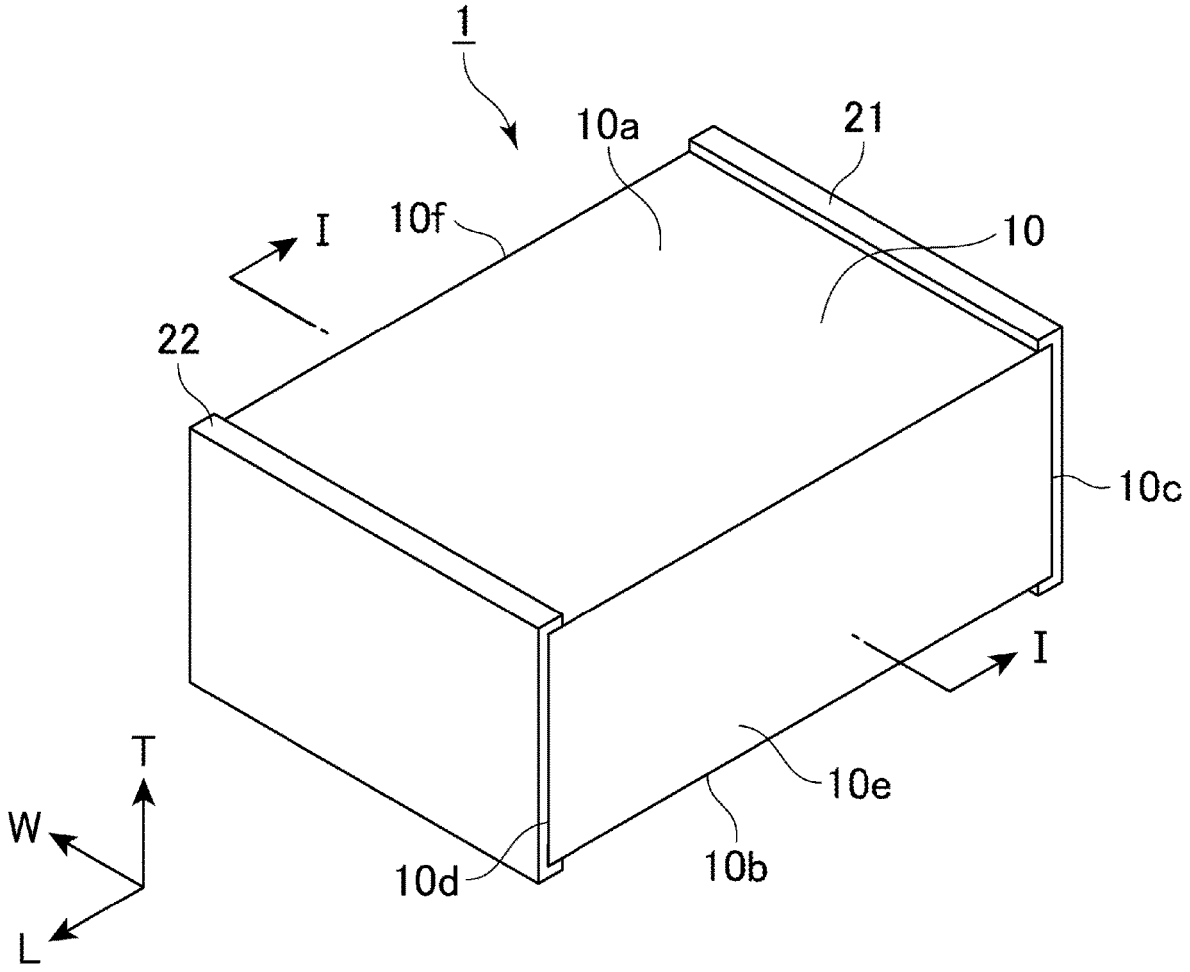
FIG. 1 is a perspective view of a coil element according to one embodiment of the present invention.
Figure 2:
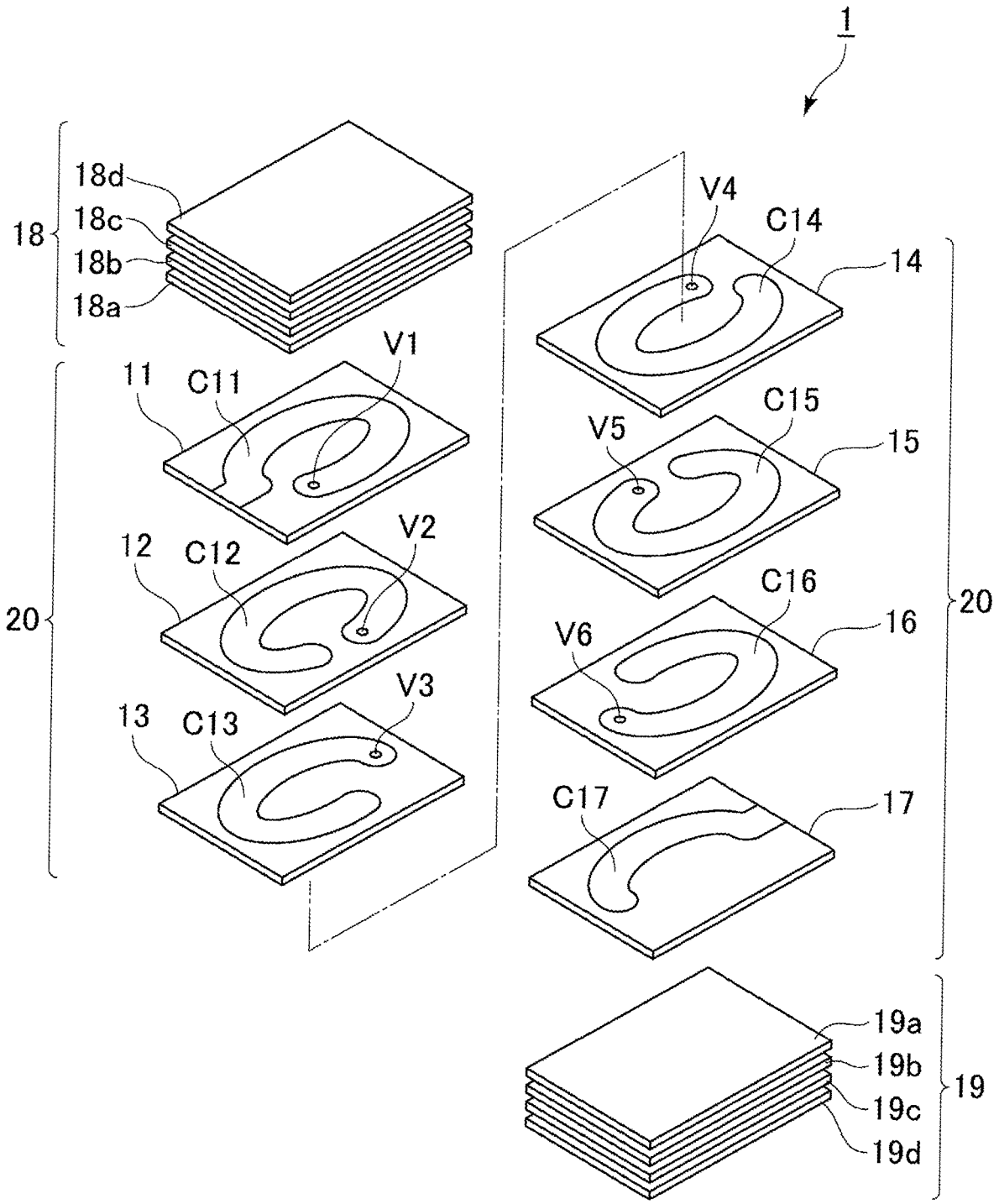
FIG. 2 is an exploded perspective view of the coil element shown in FIG. 1.
Figure 3:
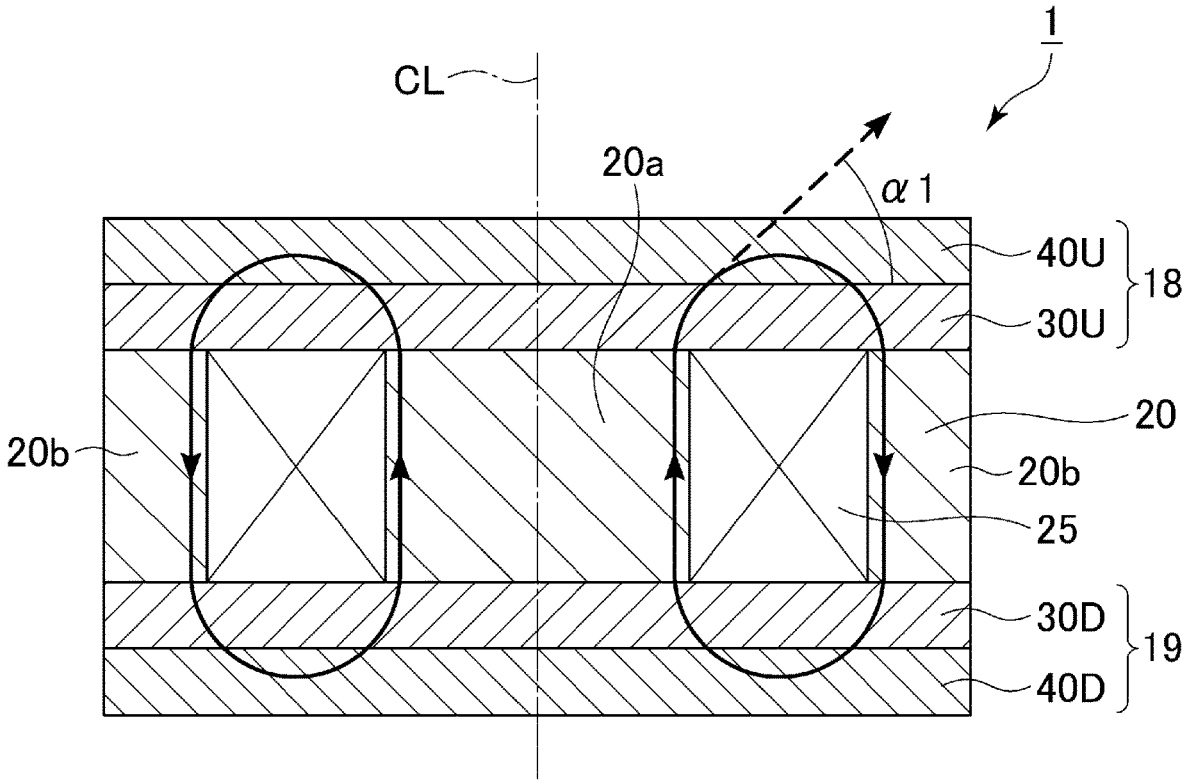
FIG. 3 schematically shows a cross section of the coil element cut along the line I-I in FIG. 1.

FIG. 1 is a perspective view of a coil element 1 according to one embodiment of the present invention, FIG. 2 is an exploded perspective view of the coil element 1 shown in FIG. 1, and FIG. 3 schematically shows a cross section of the coil element cut along the line I-I in FIG. 1.

Each of these figures shows, as one example of the coil element 1, a laminated inductor used as a passive element in various circuits. A laminated inductor is one example of a coil element to which the present invention is applicable. The present invention is applicable to a power inductor incorporated in a power source line and various other coil elements.

The coil element 1 in the embodiment shown in the figures includes an insulator body 10 made of a magnetic material, coil conductors C11 to C17 embedded in the insulator body 10, an external electrode 21 electrically connected to one end of the coil conductor C17, and an external electrode 22 electrically connected to one end of the coil conductor C11. The coil conductors C11 to C17 are each electrically connected to adjacent coil conductors through vias V1 to V6 (described later), and the coil conductors C11 to C17 connected together constitutes a coil 25.

The insulator body 10 has a first principal surface 10*a*, a second principal surface 10*b*, a first end surface 10*c*, a second end surface 10*d*, a first side surface 10*e*, and a second side surface 10*f*. The outer surface of the insulator body 10 is defined by these six surfaces. The first principal surface 10*a* and the second principal surface 10*b* are opposed to each other. The first end surface 10*c* and the second end surface 10*d* are opposed to each other. The first side surface 10*e* and the second side surface 10*f* are opposed to each other.

In FIG. 1, the first principal surface 10*a* lies on an upper side of the insulator body 10, and therefore, the first principal surface 10*a* may be herein referred to as an "upper surface." Similarly, the second principal surface 10*b* may be referred to as a "lower surface". The coil element 1 is disposed such that the second principal surface 10*b* is opposed to a circuit board (not shown), and therefore, the second principal surface 10*b* may be herein referred to as a "mounting surface". Furthermore, it is assumed that an up-down direction of the coil element 1 refers to an up-down direction in FIG. 1.

In this specification, unless otherwise contextually construed, it is assumed that a "length" direction, a "width" direction, and a "thickness" direction of the coil element 1 are indicated as an "L" direction, a "W" direction, and a "T" direction in FIG. 1, respectively.

FIG. 2 is an exploded perspective view of the coil element 1 shown in FIG. 1. The external electrode 21 and the external electrode 22 are omitted in FIG. 2. As shown, the insulator body 10 includes an insulator 20, an upper cover layer 18 provided on an upper surface of the insulator 20, and a lower cover layer 19 provided on a lower surface of the insulator 20. The insulator 20 includes insulating layers 11 to 17 stacked together. The insulator body 10 includes the upper cover layer 18, the insulating layer 11, the insulating layer 12, the insulating layer 13, the insulating layer 14, the insulating layer 15, the insulating layer 16, the insulating layer 17, the lower cover layer 19 that are stacked in this order from the positive side to the negative side in the direction of the axis T.

The insulating layers 11 to 17 contain a resin and a large number of filler particles. The filler particles are dispersed in the resin. The insulating layers 11 to 17 may not contain the filler particles.

The upper cover layer 18 is a laminate including four magnetic sheets 18*a* to 18*d* stacked together. The upper cover layer 18 includes the magnetic sheet 18*a*, the magnetic sheet 18*b*, the magnetic sheet 18*c*, and the magnetic sheet 18*d* that are stacked in this order from the positive side to the negative side in the direction of the axis T.

The magnetic sheet 18*a* and the magnetic sheet 18*b* are made of an isotropic magnetic material. The isotropic magnetic material is a composite magnetic material containing a resin and spherical filler particles.

The magnetic sheet 18*c* and the magnetic sheet 18*d* are made of an anisotropic magnetic material. The anisotropic magnetic material is a composite magnetic material containing a resin and flat-shaped filler particles.

The lower cover layer 19 is a laminate including four magnetic sheets 19*a* to 19*d* stacked together. The lower cover layer 19 includes the magnetic sheet 19*a*, the magnetic sheet 19*b*, the magnetic sheet 19*c*, and the magnetic sheet 19*d* that are stacked in this order from the positive side to the negative side in the direction of the axis T.

The magnetic sheet 19*a* and the magnetic sheet 19*b* are made of an isotropic magnetic material. The isotropic magnetic material is a composite magnetic material containing a resin and spherical filler particles. The spherical filler particles have an aspect ratio (a flattening ratio) of, for example, less than 1.5. An aspect ratio of filler particles refers to a length of the particles in a longest axis direction with respect to a length thereof in a shortest axis direction (a length in the longest axis direction/a length in the shortest axis direction).

The magnetic sheet 19*c* and the magnetic sheet 19*d* are made of an anisotropic magnetic material. The anisotropic magnetic material is a composite magnetic material containing a resin and flat-shaped filler particles.

The flat-shaped filler particles contained in the magnetic sheet 18*c*, the magnetic sheet 18*d*, the magnetic sheet 19*c*, and the magnetic sheet 19*d* have an aspect ratio (a flattening ratio) of, for example, 1.5 or more, 2 or more, 3 or more, 4 or more, or 5 or more. An aspect ratio of filler particles refers to a length of the particles in a longest axis direction with respect to a length thereof in a shortest axis direction (a length in the longest axis direction/a length in the shortest axis direction).

The flat-shaped filler particles contained in the magnetic sheet 18*c*, the magnetic sheet 18*d*, the magnetic sheet 19*c*, and the magnetic sheet 19*d* are contained in these magnetic sheets so as to assume such a posture that the longest axis direction thereof is perpendicular to the axis T (corresponding to the coil axis CL described later) and the shortest axis direction thereof is parallel to the coil axis CL. With the filler particles assuming such a posture, a magnetic permeability of the magnetic sheet 18*c*, the magnetic sheet 18*d*, the magnetic sheet 19*c*, and the magnetic sheet 19*d* in the direction perpendicular to the axis T is larger than that in the direction parallel to the axis T. Thus, the direction perpendicular to the axis T is the easy direction of magnetization of the magnetic sheet 18*c*, the magnetic sheet 18*d*, the magnetic sheet 19*c*, and the magnetic sheet 19*d*, and the direction parallel to the axis T is the hard direction of magnetization of these magnetic sheets. It is not necessary that all the filler particles contained in the magnetic sheet 18*c*, the magnetic sheet 18*d*, the magnetic sheet 19*c*, and the magnetic sheet 19*d* have the longest axis direction thereof accurately oriented perpendicular to the axis T.

The resin contained in the insulating layers 11 to 17, the magnetic sheets 18*a* to 18*d*, and the magnetic sheets 19*a* to 19*d* is a thermosetting resin having an excellent insulation property, such as, for example, an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The resin contained in one sheet is either the same as or different from the resin contained in another sheet.

The filler particles contained in the insulating layers 11 to 17, the magnetic sheets 18*a* to 18*d*, and the magnetic sheets 19*a* to 19*d* are particles of a ferrite material, metal magnetic particles, particles of an inorganic material such as $SiO_2$ or $Al_2O_3$, or glass-based particles. Particles of a ferrite material applicable to the present invention are, for example, particles of Ni—Zn ferrite or particles of Ni—Zn—Cu ferrite. Metal magnetic particles applicable to the present invention are made of a material in which magnetism is developed in an unoxidized metal portion, and are, for example, particles including unoxidized metal particles or alloy particles. Metal magnetic particles applicable to the present invention include particles of, for example, a Fe—Si—Cr, Fe—Si—Al, or Fe—Ni alloy, a Fe—Si—Cr—B—C or Fe—Si—B—Cr amorphous alloy, Fe, or a mixture thereof. Metal magnetic particles applicable to the present invention further include particles of Fe—Si—Al or FeSi—Al—Cr. Pressurized powder bodies obtained from these types of particles can also be used as the metal magnetic particles of the present invention. Moreover, these types of particles or pressurized powder bodies obtained therefrom each having a surface thermally treated to form an oxidized film thereon can also be used as the metal magnetic particles of the present invention. Metal magnetic particles applicable to the present invention are manufactured by, for example, an atomizing method. Furthermore, metal magnetic particles applicable to the present invention can be manufactured by using a known method. Furthermore, commercially available metal magnetic particles can also be used in the present invention. Examples of commercially available metal magnetic particles include PF-20F manufactured by Epson Atmix Corporation and SFR—FeSiAl manufactured by Nippon Atomized Metal Powders Corporation.

The coil conductors C11 to C17 are formed on the corresponding insulating layers 11 to 17, respectively. The coil conductors C11 to C17 are formed by plating, etching, or any other known method.

The vias V1 to V6 are formed at predetermined positions in the insulating layers 11 to 16, respectively. The vias V1 to V6 are formed by drilling through-holes at predetermined positions in the insulating layers 11 to 16 so as to extend through the insulating layers 11 to 16 in the direction of axis T and embedding a metal material into the through-holes.

The coil conductors C11 to C17 and the vias V1 to V6 contain a metal having excellent electrical conductivity such as Ag, Pd, Cu, Al, or any alloy of these metals.

The external electrode 21 is provided on the first end surface 10*c* of the insulator body 10. The external electrode 22 is provided on the second end surface 10*d* of the insulator body 10. As shown, the external electrode 21 and the external electrode 22 extend to the upper surface and the lower surface of the insulator body 10.

Next, a description is given of one example of a method for manufacturing the coil element 1. First, magnetic sheets are produced to form the insulating layers 11 to 17, the magnetic sheets 18*a* to 18*d*, and the magnetic sheets 19*a* to 19*d*.

More specifically, to produce the insulating layers 11 to 17, a thermosetting resin (e.g., epoxy resin) having filler particles dispersed therein is mixed with a solvent to produce a slurry. The filler particles have a spherical or flat shape. The slurry is applied to a surface of a base film made of a plastic and dried, and the dried slurry is cut to a predetermined size to obtain magnetic sheets to be used as the insulating layers 11 to 17. When the filler particles have a flat shape, the filler particles are arranged such that the longest axis direction thereof is parallel to the axis T (the coil axis CL).

To produce the magnetic sheets for the magnetic sheet 18*a*, the magnetic sheet 18*b*, the magnetic sheet 19*a*, and the magnetic sheet 19*b*, a thermosetting resin (e.g., epoxy resin) having spherical filler particles dispersed therein is mixed with a solvent to produce a slurry. The slurry is applied to a surface of a base film made of a plastic and dried, and the dried slurry is cut to a predetermined size to obtain magnetic sheets to be used as the magnetic sheet 18*a*, the magnetic sheet 18*b*, the magnetic sheet 19*a*, and the magnetic sheet 19*b*.

To produce the magnetic sheets for the magnetic sheet 18*c*, the magnetic sheet 18*d*, the magnetic sheet 19*c*, and the magnetic sheet 19*d*, a thermosetting resin (e.g., epoxy resin) having flat-shaped filler particles dispersed therein is mixed with a solvent to produce a slurry. The slurry is applied to a surface of a base film made of a plastic and dried, and the dried slurry is cut to a predetermined size to obtain magnetic sheets to be used as the magnetic sheet 18*c*, the magnetic sheet 18*d*, the magnetic sheet 19*c*, and the magnetic sheet 19*d*. The filler particles are arranged such that the longest axis direction thereof is perpendicular to the axis T (the coil axis CL).

Next, through-holes are formed at predetermined positions in the insulating layers 11 to 16 so as to extend through the insulating layers 11 to 16 in the direction of axis T.

Next, the coil conductors C11 to C17 made of a metal material (e.g., Ag) are formed on the upper surfaces of the insulating layers 11 to 17 by plating, etching, or any other known method, and the metal material is embedded into the through-holes formed in the insulating layers 11 to 16. The metal material embedded into the through-holes forms the vias V1 to V6.

Next, the insulating layers 11 to 17 are stacked together to form a laminate. The insulating layers 11 to 17 are stacked together such that the coil conductors C11 to C17 formed on the insulating layers are each electrically connected to adjacent coil conductors through the vias V1 to V6.

Next, the magnetic sheets 18*a* to 18*d* are stacked together to from an upper cover layer laminate that corresponds to the upper cover layer 18, and the magnetic sheets 19*a* to 19*d* are stacked together to from a lower cover layer laminate that corresponds to the lower cover layer 19.

Next, the laminate constituted by the insulating layers 11 to 17 is vertically sandwiched by the upper cover layer laminate corresponding to the upper cover layer 18 and the lower cover layer laminate corresponding to the lower cover layer 19, and subjected to thermocompression bonding by a pressing machine to obtain a body laminate. Next, the body laminate is segmented into units of a desired size by using a cutter such as a dicing machine, a laser processing machine, or the like to obtain a chip laminate corresponding to the insulator body 10. Next, the chip laminate is degreased and then heated. Next, a conductive paste is applied to the both end portions of the heated chip laminate to form the external electrode 21 and the external electrode 22. Thus, the coil element 1 is obtained.

Next, a description is given of the relationship between the easy direction of magnetization and the direction of the lines of magnetic force in the coil element 1 with reference to FIG. 3. FIG. 3 schematically shows a cross section of the coil element cut along the line I-I in FIG. 1. In FIG. 3, the lines of magnetic force generated from the coil conductor are represented by arrows. Also, for convenience, FIG. 3 schematically shows the coil conductors C11 to C17 electrically connected together as a coil 25, the magnetic sheet 18*a* and the magnetic sheet 18*b* as an isotropic magnetic material layer 30U, the magnetic sheet 19*a* and the magnetic sheet 19*b* as an isotropic magnetic material layer 30D, the magnetic sheet 18*c* and the magnetic sheet 18*d* as an anisotropic magnetic material layer 40U, and the magnetic sheet 19*c* and the magnetic sheet 19*d* as an anisotropic magnetic material layer 40D. The external electrode 21 and the external electrode 22 are omitted in FIG. 3. Thus, the anisotropic magnetic material layer 40U is disposed on the upper surface of the isotropic magnetic material layer 30U (the surface opposite to the coil 25), and the anisotropic magnetic material layer 40D is disposed on the lower surface of the isotropic magnetic material layer 30D (the surface opposite to the coil 25).

As shown, a magnetic portion 20 includes a core portion 20*a* formed inside the coil 25 and an outer peripheral portion 20*b* formed outside the coil 25.

As described above, the anisotropic magnetic material layer 40U and the anisotropic magnetic material layer 40D contain flat-shaped filler particles having the longest axis direction thereof oriented in the direction perpendicular to the coil axis CL. Therefore, in the anisotropic magnetic material layer 40U and the anisotropic magnetic material layer 40D, the direction perpendicular to the coil axis CL is the easy direction of magnetization.

In the coil element 1, the magnetic flux generated from the electric current flowing through the coil 25 runs in a closed magnetic path that extends through the core portion 20*a*, the isotropic magnetic material layer 30U, the anisotropic magnetic material layer 40U, the isotropic magnetic material layer 30U, the outer peripheral portion 20*b*, the isotropic magnetic material layer 30D, the anisotropic magnetic material layer 40D, and the isotropic magnetic material layer 30D and returns to the core portion 20*a*.

The magnetic flux that runs in this closed magnetic path is substantially parallel to the coil axis CL in the core portion 20*a*. In the isotropic magnetic material layer 30U, this magnetic flux is gradually curved from the direction substantially parallel to the coil axis CL toward the direction perpendicular to the coil axis CL. That is, the angle between the direction of the magnetic flux and the direction perpendicular to the coil axis CL is almost 90° in the core portion 20*a*, whereas when the magnetic flux runs from the isotropic magnetic material layer 30U into the anisotropic magnetic material layer 40U, the angle is $\alpha 1$ which is smaller than 90°. Thus, while the magnetic flux runs through the isotropic magnetic material layer 30U, the direction of the magnetic flux is changed toward the easy direction of magnetization of the anisotropic magnetic material layer 40U (that is, the direction perpendicular to the coil axis CL). Therefore, when the magnetic flux runs into the anisotropic magnetic material layer 40U, the difference between the direction of the magnetic flux and the easy direction of magnetization of the anisotropic magnetic material layer 40U is small.

In the coil element 1, when the magnetic flux runs from the outer peripheral portion 20*b* through the isotropic magnetic material layer 30D into the anisotropic magnetic material layer 40D, the direction of the magnetic flux is changed toward the easy direction of magnetization of the anisotropic magnetic material layer 40D. Therefore, when the magnetic flux runs into the anisotropic magnetic material layer 40D, the difference between the direction of the magnetic flux and the easy direction of magnetization of the anisotropic magnetic material layer 40D is small.

Figure 4:
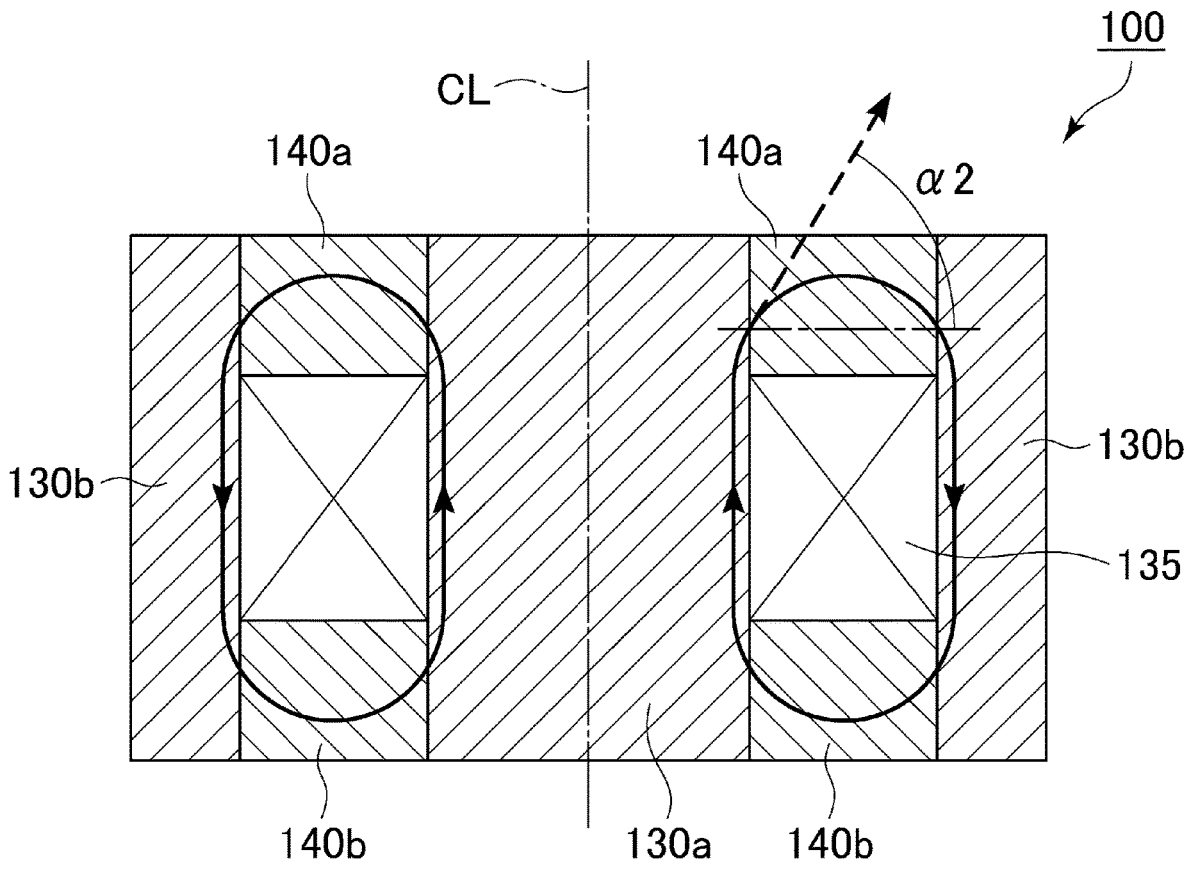
Fig. 4 (Related Art)
FIG. 4 schematically shows a cross section of a conventional coil element.

FIG. 4 schematically shows the direction of the magnetic flux in the conventional coil element disclosed in the '556 Publication. This publication discloses the coil element 100 shown in FIG. 4. The coil element 100 includes a core portion 130*a* made of an isotropic magnetic material, an outer peripheral portion 130*b* made of an isotropic magnetic material, and an anisotropic magnetic material layer 140*a* and an anisotropic magnetic material layer 140*b* both made of an anisotropic magnetic material. The anisotropic magnetic material layer 140*a* covers the upper surface of the coil 135, and the anisotropic magnetic material layer 140*b* covers the lower surface of the coil 135. In both the anisotropic magnetic material layer 140*a* and the anisotropic magnetic material layer 140*b*, the easy direction of magnetization is perpendicular to the coil axis CL.

In the conventional coil element 100 shown in FIG. 4, the magnetic flux generated from the electric current flowing through the coil conductor 135 runs in a closed magnetic path that extends through the core portion 130*a*, the anisotropic magnetic material layer 140*a*, the outer peripheral portion 130*b*, and the anisotropic magnetic material layer 140*b* and returns to the core portion 130*a*. Therefore, the magnetic flux runs into the anisotropic magnetic material layer 140*a* directly from the core portion 130*a*. The magnetic flux is substantially parallel to the coil axis CL in the core portion 130*a*, and thus the direction of the magnetic flux running from the core portion 130*a* into the anisotropic magnetic material layer 140*a* is generally parallel to the coil axis CL. That is, the angle between the direction of the magnetic flux and the direction perpendicular to the coil axis CL is almost 90° in the core portion 130*a*, and therefore, when the magnetic flux runs from the core portion 130*a* into the anisotropic magnetic material layer 140*a*, the angle between the direction of the magnetic flux and the direction perpendicular to the coil axis CL is $\alpha 2$ which is close to 90°. As described above, the easy direction of magnetization in the anisotropic magnetic material layer 140*a* is perpendicular to the coil axis CL, and therefore, in the conventional coil element 100, the difference between the direction of the magnetic flux and the easy direction of magnetization is large in the portion of the anisotropic magnetic material layer 140*a* close to the boundary with the core portion 130*a*.

In contrast, in the coil element 1 according to one embodiment of the present invention shown in FIG. 3, the magnetic flux running from the core portion 20*a* runs into the anisotropic magnetic material layer 40U via the isotropic magnetic material layer 30U, not directly into the anisotropic magnetic material layer 40U. Thus, in the isotropic magnetic material layer 30U, the direction of the magnetic flux is curved toward the direction perpendicular to the coil axis CL, and therefore, when the magnetic flux runs into the anisotropic magnetic material layer 40U, the difference between the direction of the magnetic flux and the easy direction of magnetization of the anisotropic magnetic material layer 40U is small.

As described above, in the coil element 1 according to one embodiment of the present invention, the presence of the isotropic magnetic material layer 30U and the isotropic magnetic material layer 30D lessens the difference between the direction of the magnetic flux and the easy direction of magnetization in the anisotropic magnetic material layer 40U and the anisotropic magnetic material layer 40D. Accordingly, the coil element 1 achieves an improved effective permeability as compared to conventional coil elements in which the magnetic flux runs from the side of a coil conductor directly into an anisotropic magnetic material layer.

As described above, each of the magnetic sheets 11 to 17 may contain filler particles arranged such that the longest axis direction thereof is perpendicular to the coil axis CL. When the magnetic sheets 11 to 17 contain such filler particles, the easy direction of magnetization in the magnetic sheets 11 to 17 (that is, the magnetic portion 20) is parallel to the coil axis CL. In the coil element 1, the magnetic flux in the magnetic portion 20 is parallel to the coil axis CL. Therefore, when the magnetic sheets 11 to 17 contain the filler particles arranged such that the longest axis direction thereof is parallel to the coil axis CL, the direction of the magnetic flux and the easy direction of magnetization can correspond to each other in the magnetic portion 20. Thus, the coil element 1 can have further improved effective permeability.

The dimensions, materials, and arrangements of the various constituents described in this specification are not limited to those explicitly described in the embodiments, and the various constituents can be modified to have any dimensions, materials, and arrangements within the scope of the present invention. The constituents other than those explicitly described herein can be added to the described embodiments; and part of the constituents described for the embodiments can be omitted.

For example, either the isotropic magnetic material layer 30U or the isotropic magnetic material layer 30D can be omitted from the coil element 1. For example, the coil element 1 from which the isotropic magnetic material layer 30D is omitted has the isotropic magnetic material layer 30U on the upper surface of the coil 25 but does not have the isotropic magnetic material layer 30D on the lower surface of the coil 25. In this case, it is also possible to lessen the difference between the direction of the magnetic flux and the easy direction of magnetization in the anisotropic magnetic material layer 40U on the upper surface side of the coil 25.

What is claimed is:

1. A coil element, comprising:

a coil conductor wound around a coil axis;

a core portion provided inside the coil conductor;

a first magnetic sheet provided on one of an upper surface and a lower surface of the coil conductor such that the first magnetic sheet covers at least an upper surface of the coil conductor and the core portion, the first magnetic sheet containing a plurality of first spherical filler particles;

a second magnetic sheet provided on an upper surface of the first magnetic sheet to the coil conductor such that the second magnetic sheet covers an entire area of the upper surface of the first magnetic sheet, the second magnetic sheet containing a plurality of first flat-shaped filler particles.

2. The coil element of claim 1, wherein at least some of the plurality of first flat-shaped filler particles contained in the second magnetic sheet assume such a posture that a longest axis thereof is oriented perpendicular to the coil axis.

3. The coil element of claim 1, wherein the plurality of first flat-shaped filler particles are formed of any one of Fe—Si—Cr, Fe—Ni, Fe or a mixture thereof.

4. The coil element of claim 1, wherein the plurality of first spherical filler particle s are formed of any one of Fe—Si—Al, Fe—Si—B—Cr, Fe—Si—Cr—B—C or a mixture thereof.

5. The coil element of claim 1, further comprising:

a third magnetic sheet provided on another of the upper surface and the lower surface of the coil conductor, the third magnetic sheet containing a plurality of second spherical filler particles;

a fourth magnetic sheet provided on an opposite surface of the third magnetic sheet to the coil conductor, the second magnetic sheet containing a plurality of second flat-shaped filler particles.

6. The coil element of claim 1, further comprising:

a core portion provided inside the coil conductor, wherein the core portion contains a plurality of third flat-shaped filler particles.

7. The coil element of claim 6, wherein at least some of the plurality of third flat-shaped filler particles contained in the core portion assume such a posture that a longest axis thereof is oriented parallel to the coil axis.

8. The coil element of claim 1, further comprising:

an outer peripheral portion provided outside the coil conductor, wherein the outer peripheral portion contains a plurality of fourth flat-shaped filler particles.

9. The coil element of claim 8, wherein at least some of the plurality of fourth flat-shaped filler particles contained in the outer peripheral portion assume such a posture that a longest axis thereof is oriented parallel to the coil axis.

10. The coil element of claim 1, wherein the upper surface and the lower surface are perpendicular to the coil axis.

11. The coil element of claim 1, wherein an aspect ratio of at least some of the plurality of first flat-shaped filler particles is 1.5 or more.

12. The coil element of claim 1, wherein an aspect ratio of at least some of the plurality of first spherical filler particles is less than 1.5.

13. The coil element of claim 1, wherein the second magnetic sheet covers an entire area of the core portion when viewed in the direction of the coil axis.

* * * * *